US005084988A

United States Patent [19]

Berger

[11] Patent Number: 5,084,988

[45] Date of Patent: Feb. 4, 1992

[54] SHOE, ESPECIALLY A CHILDREN'S SHOE WITH A TRANSPARENT SOLE AREA

[75] Inventor: Christoph Berger, Egloffstein, Fed. Rep. of Germany

[73] Assignee: Puma AG Rudolf Dassler Sport, Fed. Rep. of Germany

[21] Appl. No.: 508,615

[22] Filed: Apr. 13, 1990

[30] Foreign Application Priority Data

Apr. 13, 1989 [DE] Fed. Rep. of Germany ..... 8904652

[51] Int. Cl.[5] ..... A43B 3/30; A43B 13/12

[52] U.S. Cl. ..... 36/112; 36/31; 36/1

[58] Field of Search ..... 36/112, 1 R, 31, 32 R, 36/114, 30 R; 33/3 R; 340/573

[56] References Cited

U.S. PATENT DOCUMENTS

| | | | |
|---|---|---|---|
| 2,109,780 | 3/1938 | Mott | 36/1 |
| 2,126,608 | 8/1938 | Brady | 36/1 |
| 2,255,099 | 9/1941 | Brady | 36/1 |
| 2,303,431 | 12/1942 | Brophy | 36/25 R |
| 2,464,571 | 3/1949 | Gardner | 36/43 |
| 2,723,469 | 11/1955 | Shusterman | 36/112 |
| 4,398,357 | 8/1983 | Batra | 36/31 |
| 4,564,966 | 1/1986 | Chen | 36/31 |
| 4,897,936 | 2/1990 | Fuerst | 36/31 |
| 4,931,773 | 6/1990 | Rosen | 36/112 |

FOREIGN PATENT DOCUMENTS

| | | | |
|---|---|---|---|
| 7913903 | 8/1979 | Fed. Rep. of Germany . | |
| 2944995 | 5/1981 | Fed. Rep. of Germany | 36/97 |
| 2020832 | 11/1979 | United Kingdom | 33/3 R |

*Primary Examiner*—Steven N. Meyers

*Attorney, Agent, or Firm*—Sixbey, Friedman, Leedom & Ferguson

[57] ABSTRACT

A shoe consisting of an outsole and an upper, especially a children's shoe, is configured so that in a simple, inexpensive and unobtrusive way, it is possible to regularly accurately monitor or measure the distance of the toe tips of a wearer from a portion of the upper adjacent to the tip of the outsole to see in good time whether the shoe has become too small. This is achieved in that a transparent area (3) is placed within outsole (1) and extends at least over about the front third of the outsole (1). The front part of transparent area (3) serves as a support for calibrated markings (6, 7).

20 Claims, 1 Drawing Sheet

SHOE, ESPECIALLY A CHILDREN'S SHOE WITH A TRANSPARENT SOLE AREA

BACKGROUND OF THE INVENTION

The invention relates to a shoe consisting of an outsole and an upper, especially a children's shoe, with a transparent sole area that makes it possible to obtain an unhindered view of an interior portion of the shoe.

A children's shoe is usually dimensioned so that it comprises sufficient growth reserves for the foot. A shoe, for example, 100mm in length comprises a growth reserve of 12mm, relative to the inside of the shoe. But, the additional length of 12mm cannot be fully used, since, otherwise, the free growth of the yet unstabilized children's foot would be hampered because in children's feet the bones are not yet hard and the muscles are not fully developed. Both bones and flesh are still more or less deformable. For this reason, a continuous control of the growth reserve is desirable.

From German Gebrauchsmuster 79 13 903, a children's shoe is known in which the upper, in its front part, is formed of a transparent material. With it, it is supposed to be possible to be able simply and accurately to check the accuracy of fit with regard to length and ball width as well as the fit in buying a shoe.

Apart from the poor taste of the appearance of the known shoe, the possibility does not exist, during growth of the feet to continuously check accurately on how much free space is still available for the foot or for the toes, to be able to determine in good time when the shoes are too small. Further, production of such a shoe is complicated and expensive, since the connection of transparent and nontransparent parts of the upper is possible only with additional manual work.

SUMMARY OF THE INVENTION

The primary object of the present invention is, thus, to make it possible, by a simple and inconspicuous construction that does not spoil the appearance of the shoe, to regularly and accurately monitor or measure the remaining distance of the toe tips from the portion of the upper adjacent to the outsole tip to see, in good time, whether the shoe has become too small.

This object is achieved, according to a preferred embodiment of the invention, by providing a transparent area within the outsole that extends, at least, over approximately the front third of the outsole, the front part of the transparent area serving as a support for calibrated markings.

These calibrated markings are applied in the form of lines and/or numbers on the inside or outside of the transparent area or upon the inside of the sole layer in its transparent area. The markings can also be applied as elevations in the form of lines and/or numbers on the outside of the transparent area.

To form a warning zone as criterion for indicating that a shoe has become too small, the marking which corresponds to the smallest permissible distance of the toe tips from the portion of the upper adjacent to the tip of the outsole is especially distinguishable. For example, this marking can be of another form or color, or by appropriately setting the front edge of the transparent area at that point According to an advantageous configuration of the invention, another transparent area is provided within the outsole, which extends at least over about the rear fourth of the outsole. Thus, it can be observed whether, in measuring the distance of the toe tips from the front upper, the heel is resting solidly against the back part or is spaced from it, thereby, distorting the measurement result.

To avoid scratching the surface of the transparent area, according to another feature of the invention, the transparent areas are provided with a projecting edge, Whose material exhibits a greater wear resistance than the material of the transparent areas. Thus, the remaining part of the nontransparent area of the outsole can be covered with an outside layer consisting of the same material and same wear resistance as the edge, a layer joined as one piece to the edge.

According to another constructional aspect of the invention, the outsole is made from a layer consisting of transparent material extending over the entire sole area. An outside layer of a material that exhibits a greater wear resistance than the material of the transparent area is superposed on the transparent layer leaving window areas in the toe and heel areas free, and covering a projecting edge and the remaining central area.

To achieve a better support of the foot in the shoe, the layer of transparent material is pulled up on all sides like a boat and is connected to the upper. Alternatively, the layer of transparent material carries an inner layer consisting of a softer material, which is stitched to the upper, while the layer of harder transparent material is pulled up on all sides into a boat shape, the sides being connected with the upper as well as the inner layer.

Thus, the inner layer can consist of transparent material, especially of a tear-resistant plastic sheet, or it can be formed of a stitched-in textile sole, which is made from a transparent fiber material in the transparent areas.

To make a simple and cost-favorable production possible, the layers of the outsole are connected together and/or with the upper by injection molding, foaming or vulcanizing.

To increase the skidproof properties of the transparent areas, they are provided with elevations in the form of lines, nubs and/or other formations.

According to another aspect of the invention, the transparent areas of the outsole are produced of a plastic material, for example, from a vinyl polymer, polyolefin, polystyrene, polymethacrylate, polyurethane polycarbonate, thermoplastic polyacrylonitrile, or a rubber, while the nontransparent areas of the outsole are formed of such plastics as, for example, polyvinyl chloride or polyurethane, thermoplastic rubber or natural rubber.

DETAILED DESCRIPTION OF THE PREFERRED EMBODIMENT

Figure 1:
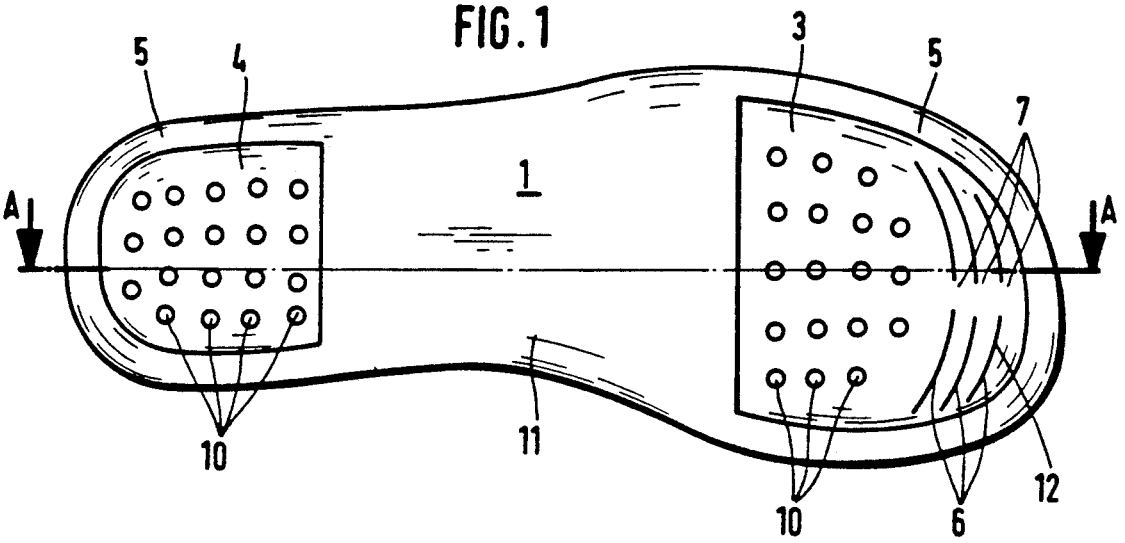
FIG. 1 is a bottom view of the outsole of a shoe according to the invention.
Figure 2:
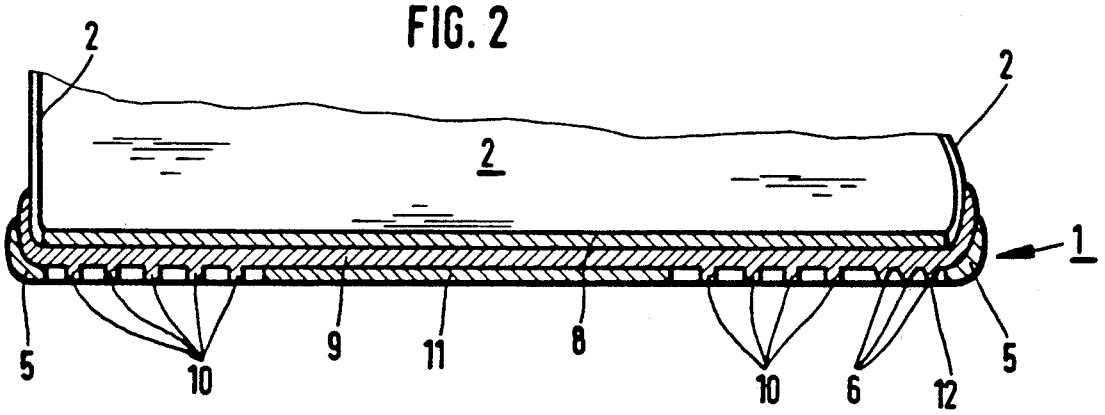
FIG. 2 is a longitudinal section through the outsole of the shoe of FIG. 1, taken along line A—A thereof.

A children's shoe, which consists of an outsole 1 and an upper 2 (only a lower portion of which is shown), has two transparent areas 3, 4 within the outsole 1. These transparent areas make possible an unhindered viewing of the inside of the shoe. The front area 3 extends over about the front third of the sole, and the rear area 4 extends over about the rear fourth of outsole 1.

In the front part of front transparent area 3, calibrated markings are applied as elevations in the form of lines 6 and/or numbers 7 formed on the outside of this transparent area 3; however, they can also be applied in the form of lines and/or numbers marked on the inside or outside of front transparent area 3 or on a layer placed on the inside of the transparent sole layer 9 at the front transparent area 3. These makings make it possible to measure the distance of the toe tip from the portion of the upper 2 that is located adjacent to the tip of outsole 1.

To form a warning zone as criterion for a shoe that has become too small, the forwardmost marking 12, which indicates the smallest properly permissible distance of the toe tips from the portion of the upper 2 that is adjacent to the tip of outsole 1, is especially set off. For example, this marking may be distinguished by another form and/or color.

A projecting edge 5 of a material having a greater wear resistance than the material of transparent areas 3,4 covers the peripheral edge of the sole. The remaining, central part of the nontransparent area of outsole 1 is covered with an outside layer 11 which is joined as one piece to edge 5, being formed of the same material and having the same wear resistance as edge 5.

Thus, the outsole 1 is made from a layer 9 consisting of transparent material extending over the entire sole area, a layer 11 being superposed on layer 9 so as to leave transparent areas 3, 4 free and covering the remaining projecting edge and central areas with a material of greater wear resistance than the material of transparent areas 3, 4.

Transparent layer 9 carries, on its inside, a layer 8 consisting of a softer material. This softer material is stitched to the upper 2, while transparent layer 9, consisting of harder material, is pulled up on all sides of the upper into a boat-like shape and connected with upper 2 as well as inner layer 8.

Inner layer 8 consists either of transparent material, especially of a tear-resistant plastic sheet, or a stitched-in textile insole which is made of a transparent fiber material in transparent areas 3, 4. The two layers 8, 9 as well as projecting edge 5, and the portion of outside layer 11 covering the remaining area, are connected together and/or with upper 2 by injection molding, foaming, gluing or vulcanizing.

With shoes made in the California method, the inner layer forming the insole or a segment insole 8 can be stitched over the entire peripheral edge with the continuous end of upper 2 applied flush.

Both transparent areas 3, 4 are provided with elevations in the form of lines 6 and/or other formations, such as round or polygonal nubs 10.

Transparent areas 3, 4 are produced from a plastic material, for example, a vinyl polymer, a polyolefin, a polystyrene, polymethacrylate, a polycarbonate, thermoplastic polyacrylonitrile, polyurethane or rubber, while the nontransparent area consists of a wear-resistant plastic, such as polyvinyl chloride, polyurethane, or thermoplastic rubber or natural rubber.

Nontransparent edge 5, in the front sole area, can basically, also be used for calibration or marking of the correct shoe size, especially if edge 5 is widened at the sole tip in the direction of the ball of the foot. In this case, the desired warning marking represents a "growing in" of the toe tips into this area or the leaving of transparent area 3 by the toe tips.

Although the invention, preferably, relates to children's shoes, other fields of application are entirely conceivable, especially in the broad sector of orthopedic shoes, rehabilitation shoes or sport shoes.

I claim:

1. A shoe comprising an outsole and an upper, especially a children's shoe, with a front transparent area making possible an unhindered view of the inside of the shoe, wherein the transparent area is formed within the outsole and extends at least over approximately the front third of the outsole and wherein a front part of the transparent area is provided with calibrated markings serving as a means for indicating proper shoe fit.

2. Shoe according to claim 1, wherein the calibrated markings are applied in the form of at least one of lines and numbers on one of an inner and an outer side of a sole layer in the transparent area.

3. Shoe according to claim 1, wherein the calibrated markings are applied as elevations on the outside of the transparent area.

4. Shoe according to claim 1, wherein one of said markings is visually set off from the other markings.

5. Shoe according to claim 4, wherein said one of the markings has another form from the other markings.

6. Shoe according to claim 4, wherein said one of the markings is of another color from the other markings.

7. Shoe according to claim 4, wherein said one of the markings is formed by a front edge of transparent area.

8. Shoe according to claim 1, wherein a second, rear transparent area is provided within the outsole and extends at least over approximately the rear fourth of the outsole.

9. Shoe according to claim 8, wherein the front transparent area and the rear transparent area are provided with a projecting edge of a material having a greater wear resistance than the material of transparent areas.

10. Shoe according to claim 9, wherein a remaining part of the outsole is nontransparent, said remaining part being covered with an outside layer, said projecting edge being formed as an integral portion of said outside layer of the same material and the same wear resistance.

11. Shoe according to claim 10, wherein the outside includes a layer comprised of transparent material which extends over the entire area of the sole, said outside layer being formed of a nontransparent material and partially covering said layer of transparent material so as to render the outsole nontransparent where the layer of transparent material is covered by the layer of nontransparent material.

12. Shoe according to claim 11, wherein the layers of the outsole are connected together with an upper by one of injection molding, foaming, gluing and vulcanizing.

13. Shoe according to claim 1, wherein the outsole is made from a layer consisting of transparent material which extends over the entire area of the sole.

14. Shoe according to claim 13, wherein the layer consisting of transparent material is pulled up on all sides of the sole into a boat-like shape and is connected to the upper.

15. Shoe according to claim 13, wherein the layer consisting of transparent material carries an inner layer which is formed of a softer material than that of the transparent layer and which is stitched to the upper 16. Shoe according to claim 15, wherein the inner layer consists of a transparent material.

17. Shoe according to claim 16, wherein the inner layer is formed of a tear-resistant sheet.

18. Shoe according to claim 15, wherein the inner layer is a stitched-in textile sole made from a transparent fiber material in the transparent area.

19. Shoe according claim 1, wherein the transparent area is provided with elevations in the form of at least one of lines and nubs.

20. Shoe according to claim 1, wherein the transparent area is produced from a plastic from the group consisting of a vinyl polymer, polyolefin, polystyrene, polymethacrylate, polycarbonate, thermoplastic polyacrylonitrile, polyurethane, and rubber.

* * * * *